US007578352B2

(12) United States Patent
Hallonquist et al.

(10) Patent No.: US 7,578,352 B2
(45) Date of Patent: Aug. 25, 2009

(54) CONTROLLED SHARED LOAD CASING JACK SYSTEM AND METHOD OF USING

(75) Inventors: David Hallonquist, Edmonton (CA); Timothy J. Mayer, Edmonton (CA)

(73) Assignee: Weatherford/Lamb, Inc., Houston, TX (US)

( * ) Notice: Subject to any disclaimer, the term of this patent is extended or adjusted under 35 U.S.C. 154(b) by 174 days.

(21) Appl. No.: 11/548,835

(22) Filed: Oct. 12, 2006 (Under 37 CFR 1.47)

(65) Prior Publication Data

US 2007/0261860 A1 Nov. 15, 2007

Related U.S. Application Data

(60) Provisional application No. 60/726,946, filed on Oct. 14, 2005.

(51) Int. Cl.
*E21B 23/08* (2006.01)

(52) U.S. Cl. ..... 166/383; 166/77.4

(58) Field of Classification Search ..... 166/77.4, 166/383, 379, 301, 382, 85.4, 85.5, 85.1; 464/163; 91/512, 517, 519, 499, 502; 254/106
See application file for complete search history.

(56) References Cited

U.S. PATENT DOCUMENTS 1,895,132 A * 1/1933 Minor ..... 166/77.4
2,126,933 A * 8/1938 Stone et al. ..... 166/77.4
2,661,063 A * 12/1953 Owens ..... 166/301
3,565,400 A * 2/1971 Yamura et al. ..... 254/106
3,598,369 A * 8/1971 Yielding ..... 254/106
4,049,237 A * 9/1977 Mattson ..... 254/106
4,476,936 A * 10/1984 Boyadjieff et al. ..... 166/383
4,595,062 A * 6/1986 Boyadjieff et al. ..... 166/379
5,188,174 A * 2/1993 Anderson, Jr. ..... 166/77.3
5,454,419 A * 10/1995 Vloedman ..... 166/277
6,343,892 B1 * 2/2002 Kristiansen ..... 40/195.1
6,814,148 B1 * 11/2004 Conner et al. ..... 166/379
7,210,525 B2 * 5/2007 Dallas ..... 166/77.4
2002/0134555 A1 * 9/2002 Allen et al. ..... 166/377
2004/0262015 A1 * 12/2004 Mazzella et al. ..... 166/383
2006/0108122 A1 * 5/2006 Buytaert et al. ..... 166/379
2006/0118294 A1 * 6/2006 Haakenson ..... 166/77.52
2006/0254776 A1 * 11/2006 Williams ..... 166/355
2007/0084606 A1 * 4/2007 Ponville ..... 166/355

* cited by examiner

*Primary Examiner*—Jennifer H Gay
*Assistant Examiner*—Cathleen R Hutchins
(74) *Attorney, Agent, or Firm*—Patterson & Sheridan, LLP

(57) ABSTRACT

A method and apparatus for removing tubulars from a wellbore is disclosed. A lifting member grips the tubular and applies a lifting force. The lifting force is then transferred to a first surface. The lifting member is monitored and when the capacity of the first surface is reached a force transfer assembly is activated. The force transfer assembly transfers the lifting load between the first surface and a second surface. The lifting member and force transfer assembly are then adjusted to maximize the amount of lifting force applied to the tubular.

39 Claims, 2 Drawing Sheets

CONTROLLED SHARED LOAD CASING JACK SYSTEM AND METHOD OF USING

CROSS-REFERENCE TO RELATED APPLICATIONS

This application claims benefit of U.S. provisional patent application Ser. No. 60/726,946, filed Oct. 14, 2005, which is here incorporated by reference.

BACKGROUND OF THE INVENTION

1. Field of the Invention

Embodiments of the present invention generally relate to a method and apparatus for removing tubulars from a wellbore. Particularly, the present invention relates to a method and apparatus for increasing the amount of lifting force applied to a wellbore tubular when removing the tubular from the ground. More particularly still, the present invention relates to a method and apparatus for distributing the lifting force between two separate load surfaces for an increased lifting force. More particularly still, the present invention relates to controlling and monitoring a lifting force between two separate load surfaces.

2. Description of the Related Art

In the operation of oil and gas wells, it is common to remove well tubulars from the wellbore. Often such tubulars are stuck in the wellbore and therefore removal from the wellbore is difficult. The types of tubulars removed are casing, drill pipe, liner, production tubing, coiled tubing, or any other type of tubular used in a wellbore. Tubulars are removed from the wellbore for a number of reasons, such as remediation or to pull out and abandon the well. Currently, tubular removal uses an elevator of a drilling rig, or a hydraulic jack placed on the rig floor, or on the wellhead surface. These systems connect to the tubular and attempt to lift the tubular and break it free from the stuck point. The tubular is then lifted out of the wellbore.

The use of an elevator to pull wellbore tubulars may be dangerous and limited under heavy load situations. The elevator pulls at the tubular with a cable and pulley system. If the gripping apparatus or cables fail while pulling, a sling shot effect is created. The movement of the gripping apparatus or cables after failure creates a great risk to workers and equipment on the drilling rig.

In order to minimize hazards presented by elevators, it is known to use hydraulic jacks to pull wellbore tubulars. The hydraulic jack systems rest either on the rig floor or on the surface of the wellbore. However, when lifting tubulars from the wellbore either on the rig floor or wellbore surface alone are often insufficient for supporting the load required to break the tubular out of the ground. To solve this problem in the past additional structural members have been welded to the drill rig floor in order to increase the loading capacity of the rig. Further, if the hydraulic jack is placed on the wellhead, the jack often extends above the rig floor. Therefore, the rig floor has to be modified to allow the jack to pass through the floor. These approach is costly and time consuming.

Further, existing hydraulic jacking systems include a plate attached to the jack which has a closed circular aperture which surrounds the tubular during removal. However, if the tubular to be gripped continues above the rig floor, such as the case with coiled tubing, it is necessary to first cut the tubular before the jack is placed over the tubular.

Therefore, there is a need for an apparatus and method of removing tubulars from a wellbore that increases the load capacity of the lifting system without the need to modify a structure. There is a further need to lift tubulars from a wellbore without the need to cut the tubular during the jacking process.

SUMMARY OF THE INVENTION

Embodiments described herein generally relate to a wellbore tubular removal system having a gripping member for gripping a tubular in a wellbore, a lifting member engagable with the gripping member for lifting the tubular, a force transfer member to transfer a lifting force from the lifting member to a surface and a force transfer assembly to distribute a lifting force between the surface and a second surface.

Embodiments relate to a wellbore tubular removal system having a gripping member for gripping a tubular in a wellbore, and a lifting member engagable with the gripping member for lifting the tubular, a force transfer assembly to transfer a lifting force from the lifting member to a first surface, a force distribution assembly to divide a lifting force between the surface, and a second surface. The lifting member is a jack, which in one embodiment includes one or more fluid operated pistons. The jack has a monitoring device for monitoring the lifting force in the lifting member. The monitoring device restricts the lifting force to the maximum force the first surface and the second may carry. The force distribution assembly is a second jack. The first surface may be a structure of the wellbore. For example, the first surface may be a blowout preventor, casing stub, or a well head of the wellbore. The second surface may be a portion of a rig floor or a rotary table. The force transfer assembly comprises a spacer spool, which rests on top of the first surface. The top of the spacer spool is engagable to the second jack. The second jack has a monitoring device for monitoring the lifting force in the second jack.

Embodiments described herein relate to a wellbore tubular removal apparatus having a tubular gripping member engaged to a first jack, a second jack configured to rest between a top of a structure and the first jack, and a force transferring assembly. The force transferring assembly engagable to the second jack and a surface of the wellbore, wherein a lifting force created by the first jack is transferred through the force transferring member to the surface. In one embodiment, the first jack comprises one or more fluid operated cylinders. The tubular removal apparatus includes a plate having an aperture through which the tubular may pass. The second jack includes an aperture which may have a semicircular configuration and one or more jacks. The second jack further includes an aperture through which the tubular may pass. The lifting force is distributed, shared and controlled between the structure and the surface upon actuation of the second jack.

Embodiment described herein relate to a method for removing a tubular in a wellbore by gripping the tubular, lifting the tubular with a lifting member, transferring a lifting force from the lifting member to a first surface via a force transferring member, and using a force transferring assembly to distribute, control and share the lifting force from the lifting member between a second surface and the first surface. The invention monitors the lifting force in the lifting member and the force transfer assembly and controls the amount of lifting force applied to the first surface and the second surface. The first surface and the second surface may be in separate horizontal planes and the tubular may be uncut coiled tubing.

Further, embodiments described herein relate to an apparatus for removing a tubular from a wellbore having a gripping member for gripping a tubular in the wellbore and a lifting member engagable with the gripping member for lifting the tubular. The lifting member comprises a jack. The jack having one or more fluid operated cylinders attachable to a plate, which may be a semicircular plate, at the top of the fluid operated cylinders. The jack having a second plate, which may be a semicircular plate, attachable to the bottom of the fluid operated cylinders. The lifting member is designed to straddle a tubular.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
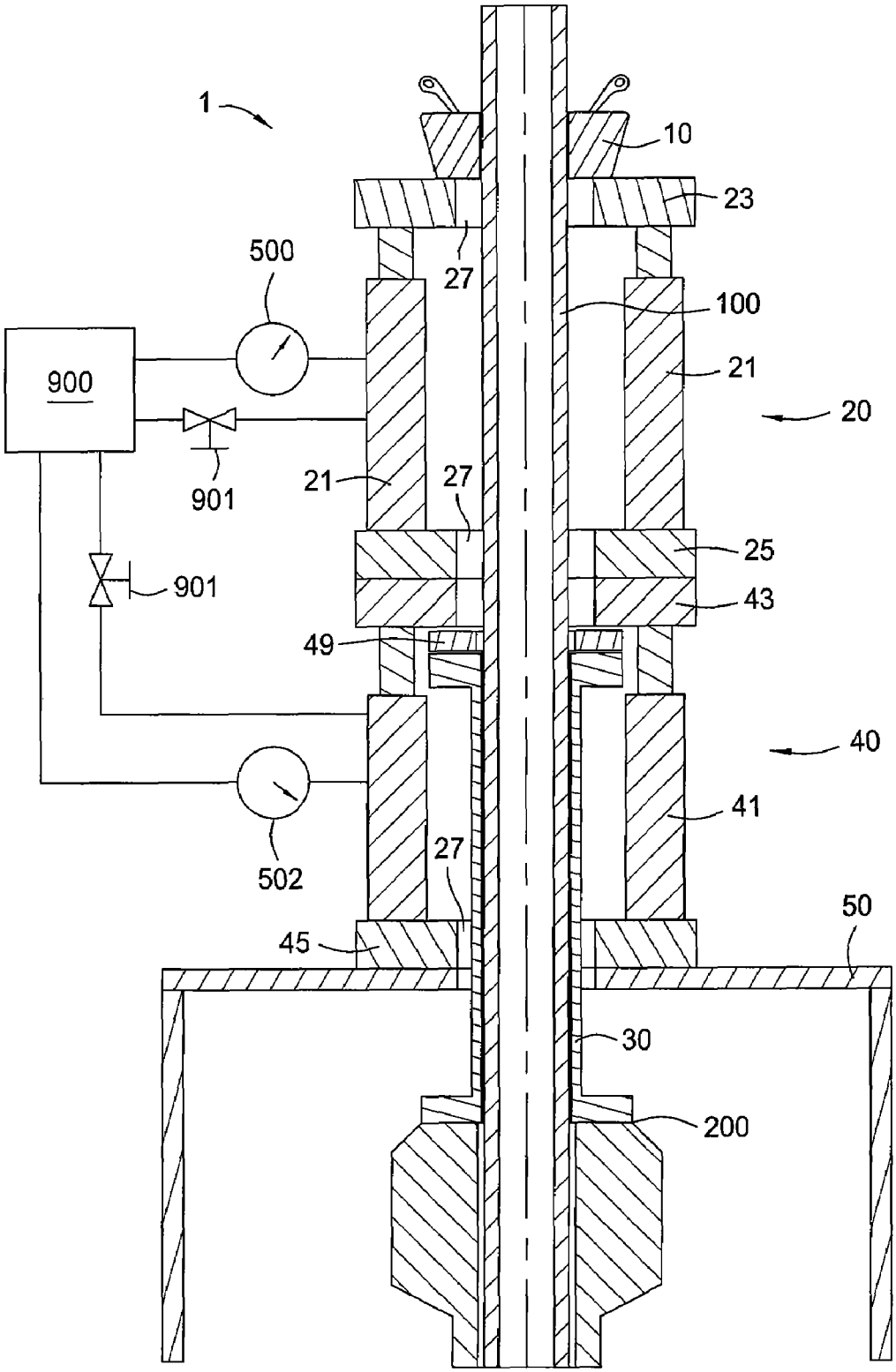
FIG. 1 is a cross sectional elevation view of a tubular attached to the lifting system according to one embodiment.

FIG. 1 illustrates a cross sectional elevation view of a tubular 100 attached to a lifting apparatus 1. The tubular 100 is any tubular for use in downhole wellbores such as, but not limited to, casing, liner, drill string, coiled tubing, and production piping. The lifting apparatus 1 includes a gripping member 10 for gripping the tubular 100. As shown, the gripping member 10 is a spider type gripper such as that disclosed in U.S. Publication No. 2004/0251055 A1, which is herein incorporated by reference; however, it should be appreciated that the gripping member 10 may be any type known in the art such as a spear, as disclosed in U.S. Publication No. 2005/0051343 A1, which is herein incorporated by reference, or any other device adapted to grip tubulars. The gripping member 10 attaches to a lifting member 20.

Figure 2:
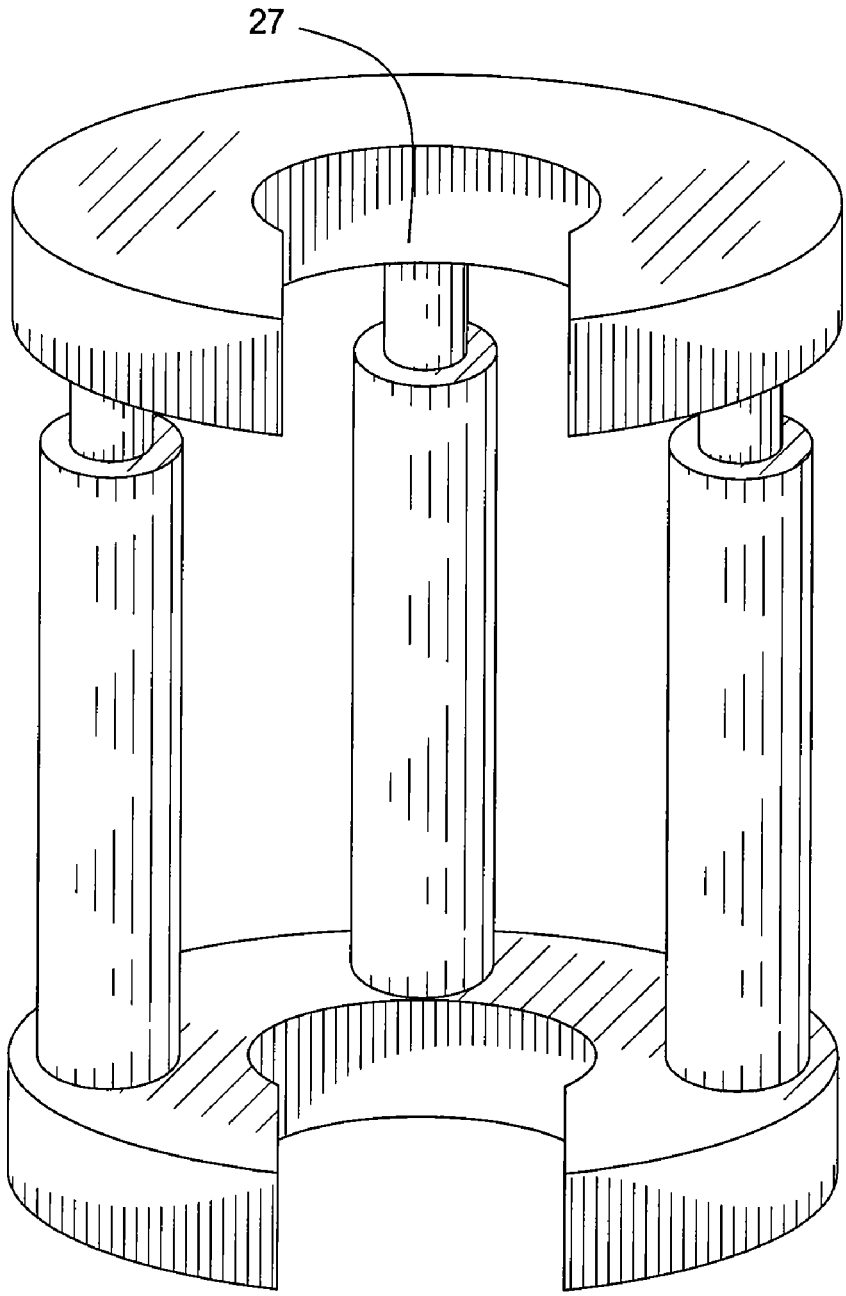
FIG. 2 is an isometric view of a jack with the semi-circular plate configuration according to one embodiment.

The lifting member 20, as shown, comprises a hydraulic jacking system with one or more fluid operated cylinders 21 attached to a top plate 23 and a bottom plate 25. The top and bottom plates 23 and 25 have an opening 27 through which the tubular 100 fits. The opening 27 forms a hole through which the tubular 100 is run through or it may have a semicircular formation as shown in FIG. 2. The semicircular or open design allows the jack to straddle the tubular 100 without the need to cut the tubular 100 if the tubular 100 is continuous or is raised high above a rig floor 50. The top and bottom plates 23 and 25 have any configuration or support scheme necessary to support the load of the lifting member 20 and allows for the tubular 100 to pass through the plates 23 and 25. Further, the lifting member 20 may comprise any type of lifting or jacking device such as a mechanical jack.

The advantage of the semicircular or c-plate configuration of plates 23 and 25, as shown in FIG. 2, is that it allows the jack to straddle any tubular 100. Often in the removal of tubulars 100 from a wellbore, the tubular extends high above the rig floor 50, or is a continuous string of tubing. Cutting the tubular 100 in order to place a jack over it is time consuming and costly. Cutting the tubular 100 often damages the integrity of the tubular 100. Thus the semicircular plates allow an operator to quickly move the lifting apparatus 1 into place and begin lifting the tubular 100. Further, only the lifting member 20 may be used for quick removal of the tubular 100.

The lifting member 20 transfers a lifting force to a surface 200 via a force transfer assembly 30. As shown, the force transfer assembly 30 is a spool piece adapted to fit around the tubular 100. The spool piece may have a circular opening through its center or be adapted, like the top and bottom plates 23 and 25, with one side open to slide around the tubular 100. The force transfer assembly 30 may also be a spilt spool piece. The split spool piece is two or more longitudinally cut spool sections which fit around the tubular and are then connected to form one unit. The spool piece may have a diameter only slightly larger than the diameter of the tubular 100. This allows the spool piece to be used without modifying the rig floor. Further, the force transfer assembly 30 may be any structure for transferring the lifting load to the surface 200, such as columns, one or more pipes, or structural members. The force transfer assembly 30, as shown, rests on top of the surface 200 at the bottom and at the top carries the lifting force from the lifting member 20.

A force distribution assembly 40 transfers the lifting force from the gripping member 10 to a second surface 50. The location of the second surface 50 is unimportant as long as the lifting force is distributed to somewhere other than the first surface 200. The force distribution assembly 40, as shown, comprises a jack which includes one or more fluid operated cylinders 41. The force distribution assembly 40 further includes a top plate 43 and a bottom plate 45. The top and bottom plates 43 and 45 are of the same type as described above for plates 23 and 25, and thus will not be described again. The force distribution assembly 40, though shown as a fluid operated jack, may be any type of lifting device such as a hydraulic, pneumatic, or mechanical jack.

The force distribution assembly 40, as shown, holds the lifting member 20 on its top plate 43. The bottom of the top plate 43 rests on the force transfer assembly 30 via a spacer plate 49. The spacer plate 49 provides for even load distribution and to shim small differences in space; however, it is not necessary for the invention. The lifting member 20 and the force distribution assembly 40 each connect to a sensor 500 and 502, respectively. The sensors 500 and 502 send data to an operator or a controller 900. The controller 900 or operator are located at any location, and if necessary far from the wellbore. The controller 900 or operator monitors and adjusts the pressure in the cylinders 21 and 41 as needed. The sensors 500 and 502 are of any type that will read the load in the lifting member 20 and force distribution assembly 40, such as a hydraulic pressure gauge, pressure sensor, a strain gage, or a scale.

The pressure sensors 500 and 502 and the controller 900 or operator ensure that the first surface 200 and second surface 50 are not overloaded. For example, the first surface 200 has maximum load of Y and the second surface 50 has a maximum load of X. The maximum loads are determined by finding the maximum load the surfaces can hold and multiplying that number by an acceptable safety factor. The controller 900, or operator, is set so that when the second sensor 502 reaches X, the loading of the force distribution assembly 40 is stopped. The lifting force or load in the force distribution assembly 40 is X'. The maximum loading of the lifting member 20 is Y plus the X'. Thus, with no lifting force in the force distribution assembly 40, the lifting member lifts a lifting force equal to the maximum load Y of the first surface 200. Once the force distribution assembly 40 is actuated, the lifting force in the lifting member 20 may increase by the equivalent amount of lifting force in the force distribution assembly 40, X'. Therefore, both the first surface 200 and the second surface 50 may carry their maximum loading. The amount of lifting force applied to the tubular 100 is increased by the maximum load capacity of each surface 50 and 200. The total maximum load of the apparatus 1 may further be determined by the maximum yield strength of the tubular 100, or the tubular couplings (not shown).

The controller 900 is capable of receiving data from the sensors 500 and 502 and other devices and is capable of controlling devices connected to it. One of the functions of the controller 900 is to prevent overloading of the surface 200 and the second surface 50. The controller 900 reads the sensors 500 and 502 and adjusts the pressure in the lifting member 20 and force distribution assembly 40 in order to prevent an overload of either of the surfaces 50 and 200. Further, the controller 900 may be equipped with a programmable central processing unit that is operable with a memory, a mass storage device, an input control unit, and an optional display unit. Additionally, the controller 900 includes well-known support circuits such as power supplies, clocks, cache, input/output circuits, and the like.

Further, the controller 900 may include or simply be one or more pumps for controlling the hydraulic pressure in the lifting member 20 and the force distribution assembly 40. The hydraulic lines running from the one or more pumps include one or more pressure relief valves 901 in order to control the amount of pressure in the hydraulic cylinders 21 and 41. The pressure relief valves 901 are adjustable. Thus, an operator or the controller 900 may adjust the one or more pressure relief valves 901 for the maximum load capacity of the first and second surfaces 50 and 200. In the alternative, an operator reads the sensors 500 and 502 and bleeds pressure from the hydraulic cylinders 21 and 41 according to the maximum load capacity of the first and second surfaces. In another alternative, the sensors 500 and 502 are pressure relief valves and they are merely preset to properly distribute the jack load wherein no direct interaction between the controller 900 or pump and the pressure relief valve is required.

In operation, the gripping apparatus 10 grips the tubular 100. The controller 900 or an operator actuates the lifting member 20 so that the hydraulic cylinders apply a lifting force on the tubular 100. At this time, the force distribution assembly 40 is inactive, thus, the full load from the lifting member 20 transfers to the surface 200 via load transfer assembly 30. As shown, the surface 200 is the wellbore surface which may comprise a blow out preventor, or a casing bowl, wellhead, or the ground, etc. The controller 900 is set to activate the force distribution assembly 40 when a first predetermined load of the surface 200 is reached. The force distribution assembly 40 then applies force to the bottom of the lifting member 20 which transfers some of the lifting load in the force transfer assembly 30 to the second surface 50. The second surface 50, as shown, is the rig floor; however, it may be a rotary table, the derrick, a platform on the derrick, a truck bed, etc. The controller 900 or operator then adjusts the load in the lifting member 20 and the force distribution assembly 40 until a second predetermined load of the surface 200 and the second surface 50 are reached. The predetermined loads may be the maximum load of the surfaces 50 and 200 or any other load desired by the operator, so long as each of the surfaces 50 and 200 are not overloaded. Further, as discussed above pressure relief valves 901 may be used to ensure that the predetermined loads of the surfaces 50 and 200 are not exceeded. This system allows an increased lifting force to be applied of a downhole tubular 100 without the need to modify the existing structure of the rig.

While the foregoing is directed to embodiments of the present invention, other and further embodiments of the invention may be devised without departing from the basic scope thereof, and the scope thereof is determined by the claims that follow.

The invention claimed is:

1. A wellbore tubular removal system comprising:

a gripping member for gripping a tubular, wherein the tubular is at least partially disposed in a wellbore;

a lifting member engagable with the gripping member for lifting the tubular;

a force transfer assembly configured to transfer a lifting force from the lifting member to a first surface, wherein the force transfer assembly comprises a spacer spool which rests on top of the first surface; and a force distribution assembly configured to distribute the lifting force between the first surface and a second surface, wherein the force distribution assembly is a distribution jack.

2. The tubular removal system of claim 1, wherein the lifting member is a transfer jack.

3. The tubular removal system of claim 2, wherein the transfer jack includes one or more hydraulic pistons.

4. The tubular removal system of claim 3, wherein the transfer jack has a monitoring device for monitoring the lifting force in the lifting member.

5. The tubular removal system of claim 4, wherein the monitoring device restricts the lifting force to a maximum force that the first surface and the second surface may carry.

6. The tubular removal system of claim 1, wherein the first surface is a structure of the wellbore.

7. The tubular removal system of claim 1, wherein the first surface is at least one of a blowout preventor, a casing bowl, the ground, and a wellhead.

8. The tubular removal system of claim 1, wherein the second surface is a portion of a rig floor.

9. The tubular removal system of claim 1, wherein the second surface is a rotary table.

10. The tubular removal system of claim 1, wherein the top of the spacer spool is engagable to the distribution jack.

11. The tubular removal system of claim 1, wherein the distribution jack has a monitoring device for monitoring the lifting force in the distribution jack.

12. A wellbore tubular removal apparatus comprising:

a gripping member engaged to a first jack for gripping a tubular;

a second jack configured to rest between a top of a structure and the first jack, wherein the first jack is located on the second jack; and a spool piece engagable to the second jack and a surface of the wellbore, wherein a lifting force created by the first jack is transferred through the spool piece to the surface.

13. The tubular removal apparatus of claim 12, wherein the first jack comprises one or more hydraulic cylinders.

14. The tubular removal apparatus of claim 12, wherein each of the first jack and second jack includes one or more plates having a semicircular configuration for distributing loading from each of the first jack and the second jack and to allow the tubular into a center of the one or more plates.

15. The tubular removal apparatus of claim 12, wherein the second jack comprises one or more hydraulic jacks.

16. The tubular removal apparatus of claim 12, wherein the lifting force is divided between the structure and the surface upon actuation of the second jack.

17. The tubular removal apparatus of claim 12, wherein the surface of the wellbore includes at least one of a blowout preventor, a casing bowl, the ground, and a well head.

18. A method for removing a tubular in a wellbore comprising:

gripping the tubular;

applying a lifting force to the tubular with a first jack, wherein the first jack is operatively coupled to a first surface;

transferring the lifting force from the first jack to the first surface using a spacer spool; and distributing the lifting force between the first surface and a second surface using a second jack.

19. The method of claim 18, further comprising monitoring the lifting force in the first jack and the second jack.

20. The method of claim 19, further comprising controlling the amount of lifting force applied to the first surface and the second surface.

21. The method of claim 18, wherein the first surface and the second surface are in separate horizontal planes.

22. The method of claim 21, wherein the second surface is a rig floor and the first surface is below the rig floor.

23. The method of claim 18, wherein the tubular is coiled tubing.

24. The method of claim 18, wherein the first surface includes at least one of a blowout preventor, a casing bowl, the ground, and a wellhead.

25. A method of freeing a tubular from a wellbore, the method comprising:

gripping the tubular;

applying a lifting force to lift the tubular using a first jack;

bearing the lifting force on a first surface using a spacer spool;

distributing the lifting force between a second surface and the first surface using a second jack; and controlling the amount of lifting force applied to the first surface and the second surface.

26. The method of claim 25, further comprising monitoring the lifting force applied to the first surface and the second surface.

27. The method of claim 25, further comprising adjusting the amount of lifting force applied to the first surface and the second surface.

28. The method of claim 25, further comprising measuring the amount of lifting force applied to the first surface and the second surface and comparing the measured amount of lifting force applied to the first surface and the second surface to a predetermined load.

29. The method of claim 28, further comprising adjusting the amount of lifting force applied to the first surface and the second surface based on the comparison of the measured amount to the predetermined load.

30. The method of claim 28, further comprising determining the predetermined load using a maximum yield strength of the tubular.

31. The method of claim 25, wherein the first surface includes at least one of a blowout preventor, a casing bowl, the ground, and a wellhead.

32. The method of claim 25, wherein the second surface is a portion of at least one of a rig floor and a rotary table.

33. A method for supporting a tubular in a wellbore comprising:

gripping the tubular;

applying a first lifting force to the tubular with a first jack, wherein the first jack is operatively coupled to a first surface;

transferring the first lifting force from the first jack to the first surface using a spacer spool; and applying a second lifting force to the first jack using a second jack to distribute the first lifting force between the first surface and a second surface.

34. The method of claim 33, wherein the second surface is a portion of at least one of a rig floor and a rotary table.

35. The method of claim 33, wherein the first surface includes at least one of a blowout preventor, a casing bowl, the ground, and a wellhead.

36. The method of claim 33, further comprising applying the second lifting force to a bottom surface of the first jack.

37. A method for supporting a tubular in a wellbore comprising:

gripping the tubular;

applying a lifting force to the tubular with a first jack, wherein the first jack is operatively coupled to a first surface, wherein the lifting force comprises a first amount that is supported by the first jack;

transferring the lifting force from the first jack to the first surface using a spacer spool; and distributing the lifting force between the first surface and a second surface using a second jack while the first jack supports the first amount of the lifting force.

38. The method of claim 37, wherein the second surface is a portion of at least one of a rig floor and a rotary table.

39. The method of claim 37, wherein the first surface includes at least one of a blowout preventor, a casing bowl, the ground, and a wellhead.

* * * * *